United States Patent [19]

Justus

[11] 4,128,455

[45] Dec. 5, 1978

[54] HEADBOX TRAILING ELEMENT MOUNTING AND METHOD

[75] Inventor: Edgar J. Justus, Beloit, Wis.

[73] Assignee: Beloit Corporation, Beloit, Wis.

[21] Appl. No.: 798,800

[22] Filed: May 20, 1977

[51] Int. Cl.[2] ..... D21F 1/02; D21F 1/06

[52] U.S. Cl. ..... 162/216; 162/341; 162/343

[58] Field of Search ..... 162/343, 344, 347, 216, 162/336, 341

[56] References Cited

U.S. PATENT DOCUMENTS

| | | | |
|---|---|---|---|
| 3,840,430 | 10/1974 | Ely | 162/343 X |
| 3,843,470 | 10/1974 | Betley et al. | 162/343 |
| 3,853,697 | 12/1974 | Parker et al. | 162/343 |
| 3,856,619 | 12/1974 | Davidson et al. | 162/343 |
| 3,888,729 | 6/1975 | Parker et al. | 162/343 |

*Primary Examiner*—Richard V. Fisher

*Attorney, Agent, or Firm*—Hill, Gross, Simpson, Van Santen, Steadman, Chiara & Simpson

[57] ABSTRACT

Thin plastic flexible trailing element sheets which divide the slice chamber of a papermaking machine headbox into substantially uniform turbulence channels between the slice opening and the flow divider plate between the slice chamber and the preslice chamber of the headbox, are anchored to the plate by means of rods having greater coefficient of thermal expansion and maintain the sheets substantially free from wrinkling in the presence of heated paper stock.

21 Claims, 4 Drawing Figures

HEADBOX TRAILING ELEMENT MOUNTING AND METHOD

This invention relates to improvements in the mounting of headbox trailing elements.

Excellent means for achieving uniform formation of paper web on a travelling forming surface comprises equipping the slice chamber of the papermaking machine headbox between the slice opening and the flow divider plate between the slice chamber and the preslice chamber with a plurality of flexible trailing sheet-form elements which extend in a cross-machine direction and are separated to form flow passages or channels therebetween, the upstream ends of the trailing elements being anchored to the plate member and the downstream ends being unattached and self-positionable so as to be solely responsive to forces exerted thereon by the stock flowing toward the slice. By way of example, U.S. Pat. Nos. 3,840,430 and 3,843,470 are referred to as general background.

One of the problems encountered with the holding or anchoring structure for the flexible trailing sheets is that while the trailing ends of the sheets may be adequately stretched by the anchoring means in a relatively unheated ordinary room temperature condition, in the presence of generally heated paper stock which may attain temperatures up to 160° F. (70° C.) and wherein the sheets expand thermally, the trailing end portions of the sheets may become undesirably wrinkled. It is to the alleviation of this problem that the present invention is directed.

It is therefore an important object of the present invention to assure substantially smooth wrinkle free functioning of the flexible trailing element sheets in the slice chamber of a headbox throughout the heat range of papermaking stock in the presence of which the trailing elements must operate.

According to important features of the present invention, there is provided in combination in a headbox having a preslice chamber and a slice chamber leading to a slice opening, the slice chamber provided with pondsides, and a perforated flow divider plate extending across and between the preslice chamber and the slice chamber, a plurality of thin flexible trailing element sheets dividing the space within the slice chamber into a plurality of stock turbulence channels and extending from said flow divider plate to adjacent the slice opening with the edges of the sheets in adjacent spaced clearance relation to the pondsides and thereby permitting lateral thermal expansion of the sheets, and sheet stretching anchoring rods mounted on the flow divider plate and having the trailing ends of said sheets attached to the rods whereby the sheets are free floating in the slice chamber, said anchoring rods having coefficient of thermal expansion greater than the coefficient of thermal expansion of the sheets and the attachment of the sheets to the rods being such that differential in thermal expansion of the rods and the sheets in the presence of hot papermaking stock causes the rods to maintain the sheets transversely stretched and substantially free from wrinkling.

According to other features of the invention, there is provided a headbox trailing element and mounting means therefor, comprising, a trailing sheet dimensioned to extend between the pondsides of a papermaking machine slice chamber and from the perforated flow divider plate between the headbox preslice chamber and the upstream end of the slice chamber to adjacent the slice opening, the dimension between the sides of the sheet being sufficiently less than the distance between the pondsides to provide for unimpeded expansion of the sheet when heated in contact with heated paper stock, and a sheet stretching anchor rod attached to the upstream end of the sheet and adapted to be received in anchoring relation in the flow divider plate, said anchoring rod having a greater coefficient of expansion than the sheet, and the attachment of the sheet to the rod being such that the same stock heat that causes expansion of the sheet will cause differentially greater expansion lengthening of the rod and thereby stretching of the trailing end portion of the sheet to maintain the sheet stretched and substantially free from wrinkling.

According to additional features of the invention, there is provided a method of maintaining trailing element sheets substantially free from wrinkling in the slice chamber of a papermaking machine headbox wherein the trailing element sheets are anchored to rods adapted to be mounted on the flow divider plate between the slice chamber and the preslice chamber of the headbox, the rods having greater coefficient of thermal expansion than the thermal coefficient of expansion of the sheets, comprising attaching the trailing element sheets to the rods in a manner to maintain the sheets substantially stretched laterally against wrinkling, and in the presence of heated paper stock effecting a greater coefficient of expansion in the rods than in the sheets and thereby maintaining the sheets stretched.

Other objects, features and advantages of the invention will be readily apparent from the following description of certain representative embodiments thereof, taken in conjunction with the accompanying drawing although variations and modifications may be effected without departing from the spirit and scope of the novel concepts embodied in the disclosure and in which.

Figure 1:
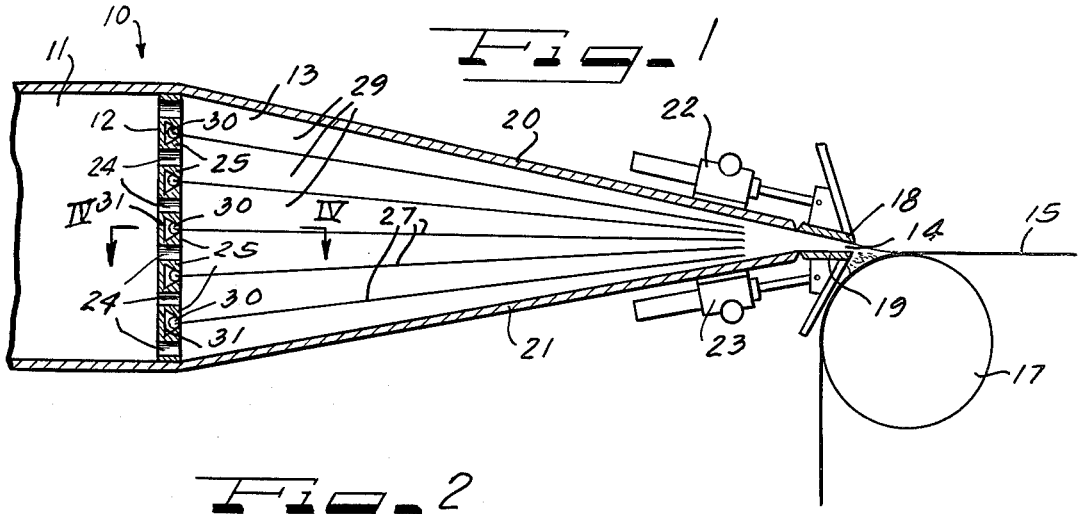
FIG. 1 is a schematic fragmentary longitudinal vertical sectional elevational view through a papermaking machine headbox embodying features of the invention.

In FIG. 1 is depicted a representative papermaking machine headbox 10 having a preslice chamber 11 which communicates through a perforated flow distribution plate 12 with the upstream end of a slice chamber 13 terminating in an adjustable slice opening 14 for delivering papermaking stock to an endless forming belt or wire 15 travelling around a breast roll 17.

The slice opening 14 is formed by upper and lower slice plates 18 and 19 adjustably pivoted to the forward ends of converging top and bottom plates 20 and 21, respectively. The slice plates 18 and 19 are pivotally mounted so as to be adjustably moved relatively toward or away from each other to adjust the size of the slice opening 14. Suitable means such as worm gear adjustment devices 22 and 23, respectively, may be provided for effecting the desired adjustments of the slice plates.

The perforated flow distribution plate 12 extends transversely relative to the chambers 11 and 13 of the headbox and is provided with a plurality of generally horizontal rows of perforations 24 separated by horizontally extending land areas 25. The width of the land areas 25 depends upon the open area of the plate required for the particular stock flow desired. For example, the overall open area provided by the perforations 24 of the plate 12 may be greater than 30%. However the openings 24 should be as small as practicable to maintain the required flow pattern, but large enough to avoid plugging, and may vary depending upon the particular application and stock characteristics to be handled.

Figure 4:
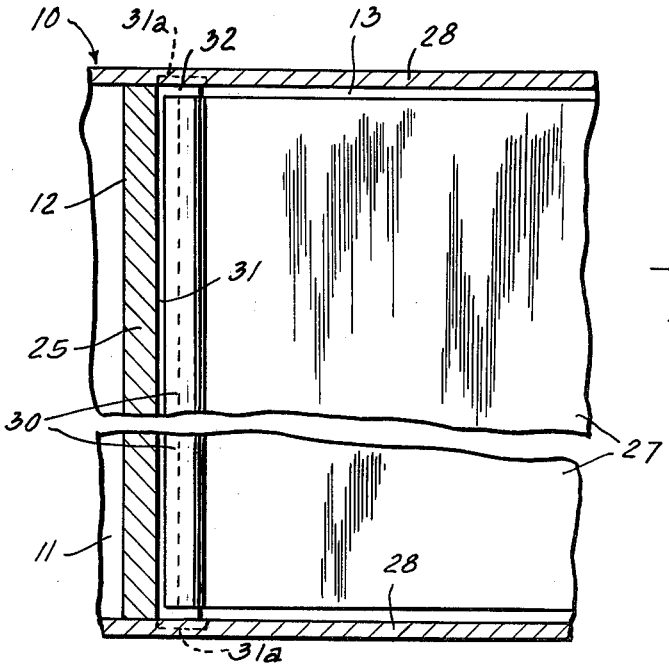
FIG. 4 is a fragmental sectional plan view taken substantially along the line IV—IV of FIG. 1.

Within the slice chamber 13 is mounted a plurality of flexible sheet-form thin plastic trailing elements 27 anchored at their upstream ends to the flow divider plate 12 and extending across the slice chamber in substantially free floating relation with their side edges in adjacently spaced relation to pondsides 28 (FIG. 4). At their free ends the sheet elements 27 extend adjacent to the slice opening 14. The function of the sheets 27 is to divide the chamber 12 into a plurality of passages or channels 29 to which the perforations 24 in the plate 12 supply papermaking stock under suitable head pressure and within which channels turbulence for fiber dispersion is maintained by the hydrodynamic effects of stock flow. Thereby the fibers of the papermaking stock are homogeneously distributed in the liquid carrier such as white water. Actually the large scale turbulence generated in the stock supply system up to the flow divider plate 12 is broken down into relatively fine scale turbulence in the plurality of channels 29.

Each of the trailing member sheets 27 is desirably in the form of a continuous thin flexible plastic sheet which may in a typical installation be of a selected thickness in a range of about 1/32 to 1/16 inch (0.075 to 1.5 mm), having a cross machine width of up to 30 feet (99 m). For the thin flexible plastic sheet material fluoroglass, i.e., $FH_4$ covered glass fiber, polycarbonate sheet, and the like, may be selected, depending upon operating requirements. At their side edges, the trailing element sheets 27 may be normally spaced from ¼ inch (6 mm) to ½ inch (12 mm) from the pondsides. The exact spacing permitted must be chosen with regard to the character of the paper stock furnish. Long fibered stock such as kraft has a greater tendency to generate large flocs than a short fibered furnish such as ground wood and therefore a narrower spacing between the sheet edges and the pondsides is desirable for the longer fibered stock furnish than the shorter fibered stock furnish since with the shorter fibered furnish there is less tendency for flocs of the stock to develop in the gaps between the pondsides and the sheet edges, especially where the stock is supplied at relatively moderate temperature. However, in view of the width of the trailing member sheets, adequate spacing between the edges of the sheets and the pondsides must be afforded to accommodate expansion of the sheets in the presence of hot stock furnish. For example, some stock may be furnished at a temperature up to 160° F. (about 70° C.). Therefore the coefficient of thermal expansion of the trailing member sheet material must be taken into account in calculating the normal or room temperature relationship of the gap spacing between the side edges of the trailing member sheets and the pondsides vis a vis the maximum thermally expanded condition of the trailing member sheets that may be expected in operation of the headbox.

Figure 2:
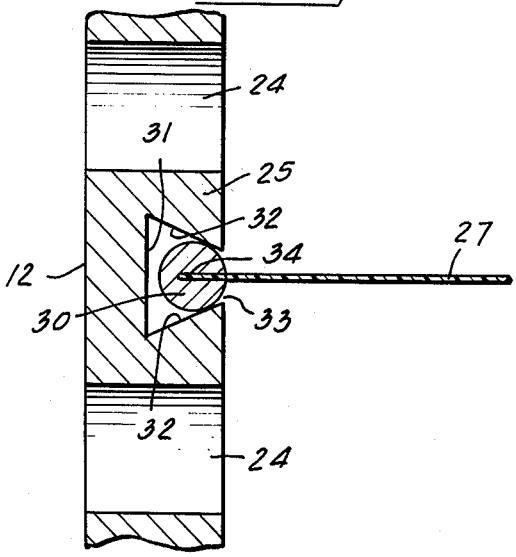
FIG. 2 is an enlarged fragmentary sectional detail view showing the anchoring structure for one of the trailing elements.

In order to permit free floating adjustment of the trailing member sheets 27 anchorage of their upstream ends to the flow distributor plate 25 is effected in a manner which will not only provide positive anchorage but will also permit the upstream ends of the sheets to adjust throughout a substantial range to the longitudinal plane of the sheet without bending strain. In a preferred arrangement as shown in FIGS. 1 and 2, the upstream end of each of the sheets 27 is secured to a cylindrical anchoring rod 30 which is received in a substantially dovetail groove socket 31 having dovetail generally convergent side walls 32 which converge toward a slot 33 which is narrower than the diameter of the rod 30 but is of ample width to permit a substantial range of swinging movement in a horizontal direction of the associated sheet 27 by rocking of the rod 30 in the groove. In the illustrated instance, the upstream end of the sheet 27 is secured tightly within a radial anchoring slot 34 in the rod 30. Assembly of the anchoring rod with the attached sheet 27 is adapted to be effected by sliding into position in the groove socket 31 from one end of the groove socket.

In the operation of the trailing member sheets 27, it is important for uniform results that the sheets remain as smoothly free of wrinkles as practicable. Inasmuch as the sheets are anchored to the land areas 25 of the flow distributor plate 12 and therefor the maximum thermal exposure of the sheets 27 to hot paper stock furnish is substantially downstream from the plate 12 due to the area of the land 25 intervening between the point of anchorage of the sheet in each instance and the perforations 24, means are provided for compensating for possibly greater tendency toward thermal expansion of the downstream portions of the sheets relative to the anchored end portions of the sheets. To this end, the anchor rods 30 are constructed to a material which has a greater coefficient of thermal expansion than the attached sheet 27. For example, stainless steel or a nonferrous material such as brass or aluminum may be employed, depending upon the differential in coefficient of expansion relative to the material of the sheet 27. If preferred, a suitable plastic material having adequate greater thermal expansion capability than the attached sheet may be used. For example, where a polycarbonate sheet, such as Lexan produced by General Electric Company, is the material of the sheet 27, the anchoring rod 30 may be an extruded polypropylene material which has a substantially greater coefficient of thermal expansion. Inasmuch as the flow directing plate 12 is customarily a metal plate, it will quickly reach the temperature of the papermaking stock and the heat of the stock will thus be transferred to the hinging, anchor bar or rod 30 and cause it to expand and lengthen. This has the effect of stretching or at least maintaining the upstream end portion of the anchored flexible trailing element sheet 27 smoothly taut substantially consistent with thermal expansion of the downstream portion of the sheet 27 in contact with the flowing heated papermaking stock directed theretoward from the flow directing plate ports or perforations 24.

Figure 3:
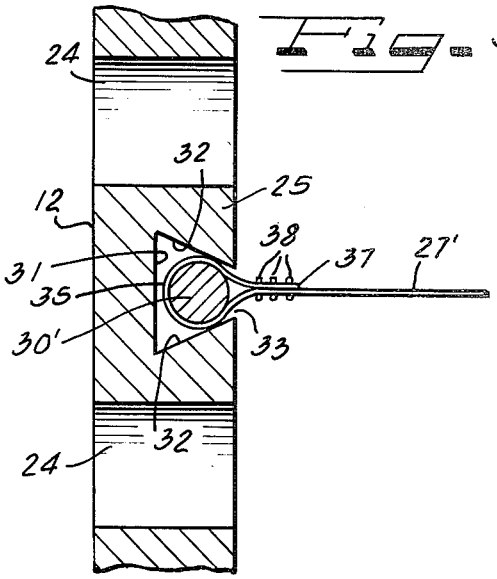
FIG. 3 is a view similar to FIG. 2 but showing a modification.

Instead of having the anchored end of the flexible trailing element sheet embedded in the hinging anchoring rod 30 as in FIG. 2, the upstream terminal portion of the thin flexible trailing sheet 27' (FIG. 3) may be tightly wrapped about the hinging anchoring bar or rod 30'. In a convenient form, the upstream end portion of the sheet 27' is wrapped as a loop 35 about the rod 30' with a terminus flange portion 37 lappingly engaging the adjacent body portion of the sheet 27' and secured thereto by suitable fastening means such as staples 38, electronic stitching or heat sealing, or the like. Where the coefficient of friction of the material of the sheet 27' and the rod 30' are low, the peripheral surface of the rod 30' may be treated to increase the frictional retention of the loop 35 with the surface of the rod, or a suitable bonding agent may be employed. The principal consideration should be that the retention of the loop 35 on the rod 30' be adequate to assure that the differential in coefficient of thermal expansion be reflected in maintaining the upstream portion of the sheet 27' stretched taut in the presence of heated papermaking stock which will cause the downstream area of the sheet 27' to expand.

From the foregoing it will be apparent that by practice of the present invention, the thin trailing element sheets 27,27' are maintained substantially smooth across their width in the operation of the associated headbox, and free from any tendency toward wrinkling in their upstream area where the downstream area of the sheets are expanded due to elevated temperatures prevailing in the papermaking stock being handled.

Where there is a desirably close gap relationship of the side edges of the trailing element sheets to the pondsides, expansion lengthening of the rods might require greater expansion room than the space between the pondsides at the ends of the groove sockets 31. Such expansion room or clearance may be provided by suitably recessing the inner surfaces of the pondsides in alignment with the ends of the groove sockets as indicated in dash outline at 31*a* in FIG. 4.

It will be understood that variations and modifications may be effected without departing from the spirit and scope of the novel concepts of this invention.

I claim as my invention:

1. In a papermaking machine headbox having a slice chamber with pondsides and extending from a perforated flow divider plate to a slice opening and through which heated paper stock passes from the flow divider plate to the slice opening:

a trailing element sheet dimensioned to extend at its sides close to said pondsides and to extend from said perforated flow divider plate longitudinally downstream in said slice chamber to adjacent the slice opening, the dimension between the sides of the sheet being sufficiently less than the distance between the pondsides to provide for unimpeded limited expansion of the sheet when heated in contact with the heated paper stock;

and a sheet stretching anchor rod attached tightly to the upstream end of the sheet and mounted in anchoring relation on the flow divider plate to permit lengthwise expansion of the rod;

said anchor rod having a greater coefficient of expansion than the sheet, and the attachment of the sheet to the rod being such that the same stock heat that causes expansion of the sheet will cause differentially greater expansion lengthening of the rod and thereby stretching of the upstream end portion of the sheet to maintain the sheet taut and substantially free from wrinkling.

2. A headbox trailing element according to claim 1, wherein the trailing element sheet comprises a thin plastic sheet, and the anchor rod comprises metal.

3. A headbox trailing element according to claim 1, wherein the trailing sheet comprises a thin flexible plastic material, and the anchor rod comprises a plastic material having a greater coefficient of thermal expansion than the material of the sheet.

4. A headbox trailing element according to claim 3, wherein the trailing element sheet material is selected from fluoroglass or polycarbonate, and the anchor rod material comprises polypropylene.

5. A headbox trailing element according to claim 1, wherein the upstream end of the sheet is embedded in the anchor rod.

6. A headbox trailing element according to claim 1, wherein the upstream end portion of the sheet is wrapped about the anchor rod.

7. A headbox trailing element according to claim 6, wherein the upstream end portion of the sheet comprises a loop wrapped about the anchor rod, and means securing the loop substantially fixed to the rod.

8. In combination in a papermaking machine headbox for handling hot papermaking stock and having a preslice chamber and a slice chamber leading to a slice opening, the slice chamber provided with pondsides, and a perforated papermaking stock flow divider plate extending across and between the preslice chamber and the slice chamber:

a plurality of thin flexible trailing element sheets dividing the space within the slice chamber into a plurality of stock turbulence channels and extending from said flow divider plate to adjacent the slice opening with the edges of the sheets in adjacent spaced clearance relation to the pondsides and thereby permitting lateral thermal expansion of the sheets;

and sheet stretching anchoring rods mounted on the flow divider plate, and each sheet having an upstream end tightly attached to a respective rod, whereby the sheets are free floating in the slice chamber;

said anchoring rods having a coefficient of thermal expansion greater than the coefficient of thermal expansion of the sheets and the attachment of the sheets to the rods being such that differential in thermal expansion of the rods and the sheets in the presence of hot papermaking stock causes the rods to maintain the sheets transversely taut and substantially free from wrinkling.

9. A combination according to claim 8, wherein said divider plate has transverse lands between flow divider perforations therein, retaining groove sockets in the slice chamber face of the lands of said plate, said anchoring rods being engaged in said sockets.

10. A combination according to claim 9, wherein said plate is metal, and said anchoring rods are in heat transfer relation engagement with the plate in said sockets.

11. A combination according to claim 8, wherein said flow divider plate is metal and exposed to the heat of hot papermaking stock in the preslice chamber and in passing through the perforations in the plate, and said anchoring rods being in heat transfer relation to the plate.

12. A combination according to claim 8, wherein said trailing element sheets comprise thin plastic sheet material, and said anchoring rods comprise metal.

13. A combination according to claim 8, wherein said trailing element sheets comprise thin flexible plastic material, and the anchoring rods comprise a plastic material having a greater coefficient of thermal expansion than the material of the sheets.

14. A combination according to claim 13, wherein the trailing element sheet material is selected from fluoroglass or polycarbonate, and the anchoring rod material comprises polypropylene.

15. A combination according to claim 8, wherein the upstream ends of the sheets are embedded in the anchoring rods.

16. A combination according to claim 8, wherein the upstream end portions of the sheets are wrapped about the anchoring rods.

17. A combination according to claim 16, wherein the upstream end portions of the sheets comprise respective loops wrapped about the anchoring rods, and means securing the loops substantially fixed to the rods.

18. A method of maintaining trailing element sheets substantially free from wrinkling in the presence of heated papermaking stock in the slice chamber of a papermaking machine headbox having a flow divider plate between a slice chamber and a preslice chamber, said sheets extending downstream in said slice chamber, comprising:

providing anchor rods of greater coefficient of thermal expansion than the thermal coefficient of expansion of the sheets attaching the trailing element sheets to the rods in a manner to hold the sheets substantially taut laterally;

and mounting said rods and thereby the upstream ends of said sheets on said plate in a manner permitting the rods freedom for thermal expansion;

whereby greater rate of expansion of more directly heated downstream areas of the sheets in the slice chamber than the rate of expansion of upstream areas of the sheets will be compensated for by heat of the heated papermaking stock thermally expanding and lengthening the rods and thereby stretching and maintaining the upstream areas of the sheets stretched taut and free from wrinkling.

19. A method according to claim 18, comprising embedding the upstream ends of the trailing element sheets in the rods and thereby tightly attaching the sheets to the rods.

20. A method according to claim 18, comprising wrapping the upstream end portion of each of the sheets onto the respective rods and maintaining grip of the wrapped portions of the sheets on the rods, so that expansion lengthening of the rods when heated will cause taut stretching of the upstream ends of the sheets.

21. A method according to claim 18, wherein the flow divider plate is metal and heated by contact with the heated papermaking stock, mounting the anchor rods on the plate in heat transfer relation, and transferring the heat from the papermaking stock to the rods.

* * * * *